US009316095B2

(12) United States Patent
Holderman

(10) Patent No.: US 9,316,095 B2
(45) **Date of Patent: *Apr. 19, 2016**

(54) AUTONOMOUS INFLOW CONTROL DEVICE HAVING A SURFACE COATING

(71) Applicant: HALLIBURTON ENERGY SERVICES, INC., Houston, TX (US)

(72) Inventor: Luke William Holderman, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/126,416

(22) PCT Filed: Jan. 25, 2013

(86) PCT No.: PCT/US2013/023262

§ 371 (c)(1),
(2) Date: Dec. 14, 2013

(87) PCT Pub. No.: WO2014/116236

PCT Pub. Date: Jul. 31, 2014

(65) Prior Publication Data

US 2015/0053417 A1 Feb. 26, 2015

(51) Int. Cl.
*E21B 43/12* (2006.01)
*E21B 34/08* (2006.01)

(52) U.S. Cl.
CPC ..... *E21B 43/12* (2013.01); *E21B 34/08* (2013.01)

(58) Field of Classification Search
CPC ..... E21B 43/12; E21B 34/06; E21B 43/08; E21B 34/08
See application file for complete search history.

(56) References Cited

U.S. PATENT DOCUMENTS

| | | | | |
|---|---|---|---|---|
| 3,586,104 | A | 6/1971 | Hyde | |
| 8,474,534 | B1 * | 7/2013 | Fripp et al. | 166/319 |
| 2007/0047388 | A1 * | 3/2007 | DeNatale et al. | 366/341 |
| 2011/0139453 | A1 | 6/2011 | Schultz et al. | |
| 2011/0186300 | A1 * | 8/2011 | Dykstra et al. | 166/316 |
| 2011/0214876 | A1 | 9/2011 | Dykstra et al. | |
| 2011/0266001 | A1 | 11/2011 | Dykstra et al. | |
| 2011/0297384 | A1 | 12/2011 | Fripp et al. | |
| 2011/0297385 | A1 | 12/2011 | Dykstra et al. | |
| 2011/0308806 | A9 | 12/2011 | Dykstra et al. | |
| 2012/0048561 | A1 | 3/2012 | Holderman | |
| 2012/0048563 | A1 | 3/2012 | Holderman | |
| 2012/0060624 | A1 * | 3/2012 | Dykstra | 73/861.22 |

(Continued)

OTHER PUBLICATIONS

Foreign Communication from a Related Counterpart Application, International Search Report and Written Opinion dated Oct. 22, 2013, International Application No. PCT/US13/23262 filed on Jan. 25, 2013.

(Continued)

*Primary Examiner* — Nicole Coy
(74) *Attorney, Agent, or Firm* — Scott Richardson; Baker Botts L.L.P.

(57) ABSTRACT

An autonomous inflow control system for use downhole comprises a flow ratio control system comprising one or more fluid inlets, and a pathway dependent resistance system comprising a vortex chamber. The one or more fluid inlets provide fluid communication between the flow ratio control system and the pathway dependent resistance system, and at least one of the one or more fluid inlets comprises a super hydrophobic surface.

20 Claims, 7 Drawing Sheets

(56) References Cited

U.S. PATENT DOCUMENTS

| | | | | |
|---|---|---|---|---|
| 2012/0111577 | A1 | 5/2012 | Dykstra et al. | |
| 2012/0125120 | A1 | 5/2012 | Dykstra | |
| 2012/0145385 | A1 | 6/2012 | Lopez | |
| 2012/0181036 | A1 | 7/2012 | Holderman | |
| 2012/0181037 | A1 | 7/2012 | Holderman | |
| 2012/0234557 | A1 | 9/2012 | Dykstra et al. | |
| 2012/0255351 | A1 | 10/2012 | Dykstra | |
| 2012/0255740 | A1 | 10/2012 | Fripp et al. | |
| 2012/0279593 | A1 | 11/2012 | Fripp et al. | |
| 2012/0292018 | A1 | 11/2012 | Schultz et al. | |
| 2013/0048301 | A1 | 2/2013 | Gano et al. | |
| 2013/0056217 | A1 | 3/2013 | Dykstra et al. | |
| 2013/0075107 | A1 | 3/2013 | Dykstra et al. | |
| 2013/0075112 | A1 | 3/2013 | Franklin et al. | |
| 2013/0092381 | A1 | 4/2013 | Dykstra et al. | |
| 2013/0092382 | A1 | 4/2013 | Dykstra et al. | |
| 2013/0092392 | A1 | 4/2013 | Dykstra et al. | |
| 2013/0092393 | A1 | 4/2013 | Dykstra et al. | |
| 2013/0153238 | A1 | 6/2013 | Fripp et al. | |
| 2013/0161018 | A1* | 6/2013 | Fripp et al. | 166/319 |
| 2013/0180727 | A1 | 7/2013 | Dykstra et al. | |
| 2013/0186626 | A1 | 7/2013 | Aitken et al. | |
| 2013/0186634 | A1 | 7/2013 | Fripp et al. | |
| 2013/0186639 | A1 | 7/2013 | Zhao et al. | |
| 2013/0213667 | A1 | 8/2013 | Lopez et al. | |
| 2013/0220633 | A1 | 8/2013 | Felten | |
| 2013/0299198 | A1 | 11/2013 | Gano et al. | |
| 2014/0000869 | A1 | 1/2014 | Holderman et al. | |
| 2014/0014351 | A1 | 1/2014 | Zhao et al. | |
| 2014/0041731 | A1 | 2/2014 | Fripp et al. | |
| 2014/0048279 | A1 | 2/2014 | Holderman | |
| 2014/0048280 | A9 | 2/2014 | Fripp et al. | |
| 2014/0048282 | A1 | 2/2014 | Dykstra et al. | |
| 2014/0083675 | A1 | 3/2014 | Grigsby et al. | |
| 2014/0083682 | A1 | 3/2014 | Grigsby et al. | |
| 2014/0083690 | A1 | 3/2014 | Tips et al. | |
| 2014/0083691 | A1 | 3/2014 | Tips et al. | |
| 2014/0083714 | A1 | 3/2014 | Grigsby | |
| 2014/0083766 | A1 | 3/2014 | Tips et al. | |
| 2014/0090857 | A1 | 4/2014 | Fripp et al. | |
| 2014/0110127 | A1 | 4/2014 | Zhao | |
| 2014/0144616 | A1 | 5/2014 | Greci | |

OTHER PUBLICATIONS

Holderman, Luke William, International Application entitled, "Autonomous Inflow Control Device Having a Surface Coating", filed on Jan. 25, 2013, PCT Serial No. PCT/US13/23262.

Holderman, Luke William, Patent Application entitled "Autonomous Inflow Control Device Having a Surface Coating", filed on Dec. 14, 2013, U.S. Appl. No. 14/106,716.

International Preliminary Report on Patentability issued in related PCT Application No. PCT/US2013/023262, mailed Aug. 6, 2015 (9 pages).

* cited by examiner

AUTONOMOUS INFLOW CONTROL DEVICE HAVING A SURFACE COATING

CROSS-REFERENCE TO RELATED APPLICATIONS

This application is a filing under 35 U.S.C. 371 as the National Stage of International Application No. PCT/US13/023262, filed Jan. 25, 2013, entitled "AUTONOMOUS INFLOW CONTROL DEVICE HAVING A SURFACE COATING," by Luke William Holderman, which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are drilled into subterranean formations to produce one or more fluids from the subterranean formation. For example, a wellbore may be used to produce one or more hydrocarbons. During production operations, it is common for an undesired fluid to be produced along with a desired fluid. For example, water may be produced along with hydrocarbons. In addition, the flow rate of a fluid from a subterranean formation into a wellbore may be greater in one zone compared to another zone. Where fluids are produced from a long interval of a formation penetrated by a wellbore, balancing the production of fluid along the interval can lead to reduced water and gas coning and more controlled conformance, thereby increasing the proportion and overall quantity of oil or other desired fluid produced from the interval. Various devices and completion assemblies can be used to help balance the production of fluid from an interval in the wellbore.

SUMMARY

In an embodiment, an autonomous inflow control device for use downhole comprises a flow ratio control system comprising one or more fluid inlets, and a pathway dependent resistance system comprising a vortex chamber. The one or more fluid inlets provide fluid communication between the flow ratio control system and the pathway dependent resistance system, and at least one of the one or more fluid inlets comprises a super hydrophobic surface.

In an embodiment, an autonomous inflow control device for use downhole comprises a flow ratio control system comprising one or more fluid inlets, and a pathway dependent resistance system comprising a vortex chamber. The one or more fluid inlets provide fluid communication between the flow ratio control system and the pathway dependent resistance system, and the vortex chamber comprises a super hydrophobic surface disposed over at least a portion of the vortex chamber.

In an embodiment, a method of providing a variable resistance to fluid flow in a wellbore comprises receiving a fluid within a flow passage of an autonomous inflow control device, and changing the resistance to flow of at least a portion of the fluid based on contacting the portion of the fluid with a surface within the autonomous inflow control device.

The resistance to flow through the autonomous inflow control device varies based on a fluid pathway through the autonomous inflow control device.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
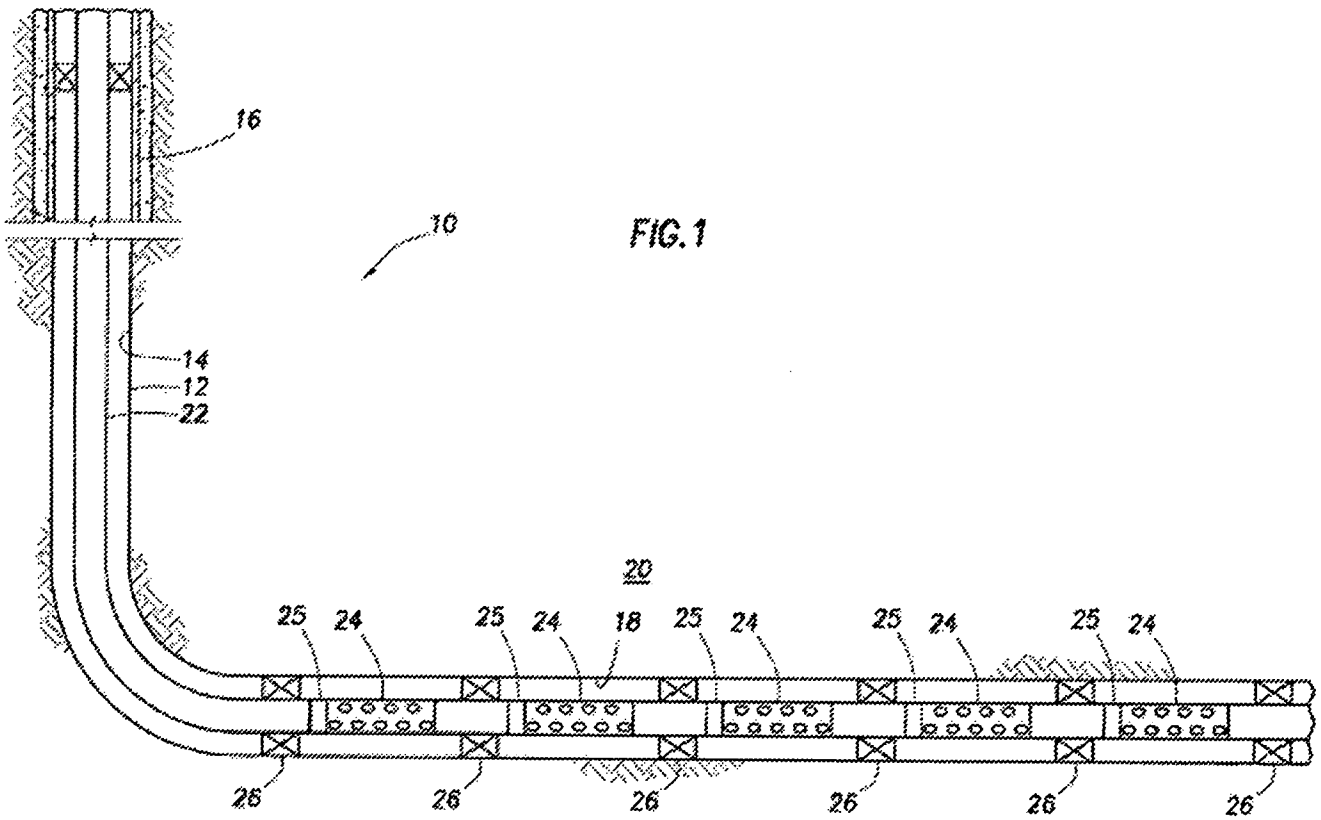
FIG. 1 is a schematic illustration of a well system according to an embodiment of the present invention.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that that present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

Well systems may be used to provide a completion configuration including one or more flow control devices intended to balance production along a section of a wellbore. A flow control device may form a part of a well completion/production system (e.g., a well screen assembly) and thereby affect fluid flow into a wellbore tubular interior. Some systems may include flow control devices comprising a vortex chamber leading into the wellbore tubular interior, where undesired fluids can be separated to some degree from desired fluids in a flow control section prior to entering the vortex chamber. In order to achieve this separation, these devices direct undesired fluid to flow primarily tangentially into the vortex chamber, while directing desired fluid to flow primarily radially into the vortex chamber. Through the use of differential flow paths for fluids with varying properties, these flow control devices aim to restrict the fluid flow of the undesired fluid to a greater degree than the flow of a desired fluid. For example, a tangential entrance can cause undesired fluids to swirl around the vortex chamber and thus provide resistance to the flow therethrough, thereby increasing the resistance to flow of the undesired fluid through the device.

Disclosed herein is an autonomous inflow control device ("AICD") comprising flow ratio control system and a pathway dependent resistance system, one or both of which may comprise a portion coated with a surface coating and/or surface features (e.g., a hydrophobic compound, a super hydrophobic compound, etc.) for use within a wellbore. Various configurations of the autonomous flow control device are possible. In some embodiments, only pathway dependent resistance system or a portion of the flow ratio control system of the autonomous inflow control device comprises a surface coating and/or surface features. In other embodiments, the pathway dependent resistance system as well as at least a portion of the flow ratio control system comprises a surface coating and/or surface features. In some embodiments, multiple portions of the vortex chamber comprise various surface coatings and/or surface features, thereby providing a plurality of interfacial surface tensions throughout the vortex chamber. In some embodiments, at least one portion of the vortex chamber comprises at least one surface coating and/or surface features, while at least a portion of the fluid outlet comprises at least one surface coating and/or surface features. In some embodiments, the surface coating and/or surface features make the surface hydrophobic or hydrophilic. In some embodiments, the surface coating and/or surface features make the surface super hydrophobic.

The modification of the interfacial energies within the autonomous inflow control device may allow for a greater separation within the flow ratio control system and/or a greater difference in the resistance to flow between desired fluids and undesired fluids in the pathway dependent resistance system. Such results may allow for a greater flow rate of fluid through an existing autonomous inflow control device, or the autonomous inflow control device can be reduced in size with the same separation and resistance characteristics.

FIG. 1 is a schematic illustration of a well system, indicated generally 10, including a plurality of autonomous inflow control devices embodying principles of the present invention. A wellbore 12 extends through various earth strata. The wellbore 12 has a substantially vertical section 14, the upper portion of which has installed therein a casing string 16. The wellbore 12 also has a substantially deviated section, shown as horizontal ("horizontal section 18"), which extends through a hydrocarbon bearing subterranean formation 20. As illustrated, the substantially horizontal section 18 of the wellbore 12 is open hole. While the horizontal section 18 of the wellbore 12 is shown as an open hole, the invention will work in any orientation and in open or cased hole.

Positioned within wellbore 12 and extending from the surface is a tubing string 22. Tubing string 22 provides a conduit for fluids to travel from formation 20 upstream to the surface. Positioned within tubing string 22 in the various production intervals adjacent to formation 20 are a plurality of autonomous flow control systems 25 and a plurality of production tubing sections 24. At either end of each production tubing section 24 is a packer 26 that provides a fluid seal between tubing string 22 and the wall of the wellbore 12. The space in-between each pair of adjacent packers 26 defines a production interval.

Each of the production tubing sections 24 may optionally include sand control capability. Sand control screen elements or filter media associated with production tubing sections 24 are designed to allow fluids to flow therethrough but prevent particulate matter of sufficient size from flowing therethrough. In an embodiment, the filter media is of the type known as "wire-wrapped," since it is made up of a wire closely wrapped helically about a wellbore tubular, with a spacing between the wire wraps being chosen to allow fluid flow through the filter media while keeping particulates that are greater than a selected size from passing between the wire wraps. It should be understood that the generic term "filter media" as used herein is intended to include and cover all types of similar structures which are commonly used in gravel pack well completions which permit the flow of fluids through the filter or screen while limiting and/or blocking the flow of particulates (e.g. other commercially-available screens; slotted or perforated liners or pipes; sintered-metal screens; sintered-sized, mesh screens; screened pipes; prepacked screens and/or liners; or combinations thereof). Also, a protective outer shroud having a plurality of perforations therethrough may be positioned around the exterior of any such filter medium.

Through the use of the flow control system 25 of the present invention in one or more production intervals, some control over the volume and composition of the produced fluids is enabled. For example, in an oil production operation, if an undesired fluid component, such as water, steam, carbon dioxide, or natural gas, is entering one of the production intervals, the flow control system 25 in that interval will autonomously restrict or resist production of the undesired fluid from that interval. It will be appreciated that whether a fluid is a desired or an undesired fluid depends on the purpose of the production or injection operation being conducted. For example, if it is desired to produce oil from a well, but not to produce water or gas, then oil is a desired fluid and water and gas are undesired fluids.

The fluid flowing into the production tubing section 24 typically comprises more than one fluid component. Typical components are natural gas, oil, water, steam, or carbon dioxide. The proportion of these components in the fluid flowing into each production tubing section 24 will vary over time and based on conditions within the formation 20 and the wellbore 12. Likewise, the composition of the fluid flowing into the various production tubing sections 24 throughout the length of the entire production string can vary significantly from section to section. The flow control system 25 is designed to reduce or restrict from any particular interval the production of undesired fluids. Accordingly, a greater proportion of desired fluid component (e.g., oil) will be produced into the interior of the wellbore 12.

Although FIG. 1 depicts one flow control system in each production interval, it should be understood that any number of systems of the present invention can be deployed within a production interval without departing from the principles of the present invention. Likewise, the inventive flow control systems do not have to be associated with every production interval. They may only be present in some of the production intervals of the wellbore or may be in the wellbore interior to address multiple production intervals.

Figure 2:
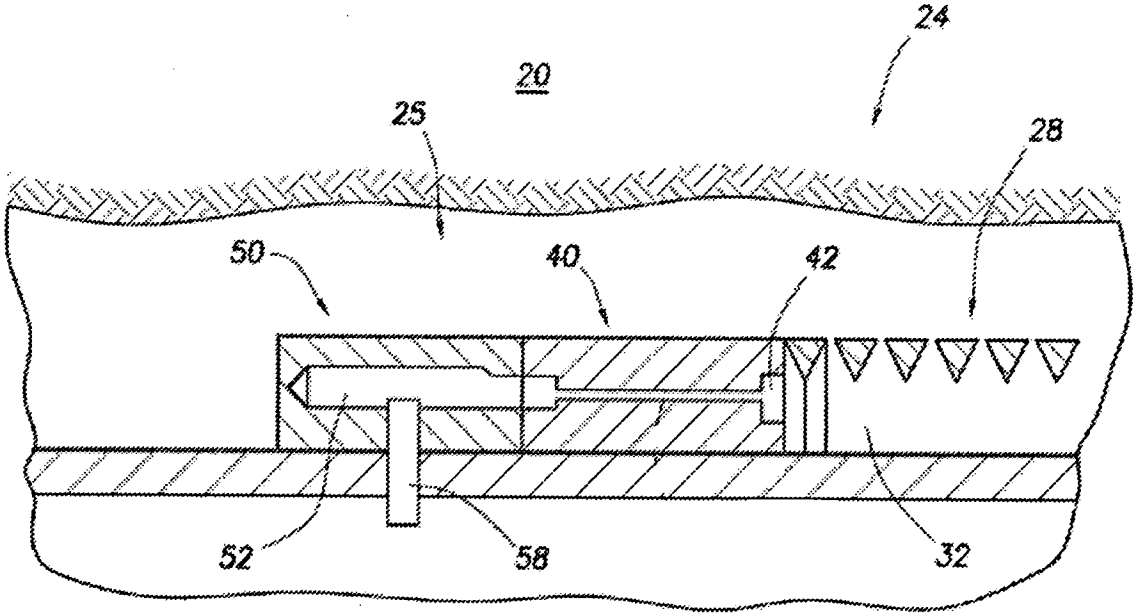
FIG. 2 is a side view in cross-section of a screen system, an inflow control system, and a flow control system according to the present invention.

FIG. 2 is a side view in cross-section of a screen system 28, and an embodiment of an autonomous flow control system 25 of the invention having a flow direction control system, including a flow ratio control system 40, and a pathway dependent resistance system 50. The production tubing section 24 has a screen system 28, an optional inflow control device (not shown) and an autonomous flow control system 25. The production tubular defines an interior passageway 32. The fluid flows from the formation 20 into the production tubing section 24 through screen system 28. The specifics of the screen system 28 are not explained in detail here. The fluid, after being filtered by the screen system 28, if present, flows into the interior passageway 32 of the production tubing section 24. As used here, the interior passageway 32 of the production tubing section 24 can be annular space, as shown, a central cylindrical space, or other arrangement. In practice, downhole tools will have passageways of various structures, often having the fluid flow through annular passageways, central openings, coiled or tortuous paths, and other arrangements for various purposes. The fluid may be directed through a tortuous passageway or other fluid passages to provide further filtration, fluid control, pressure drops, etc. The fluid then flows into the flow control system, if present. Various flow control systems are well known in the art and are not described here in detail. An example of such a flow control system is commercially available from Halliburton Energy Service, Inc. under the trademark EquiFlow®. The fluid then flows into the inlet 42 of the autonomous flow control system 25. While suggested here that the additional flow control system be positioned upstream from the inventive device, it could also be positioned downstream of the inventive device or in parallels with the inventive device.

Figure 3:
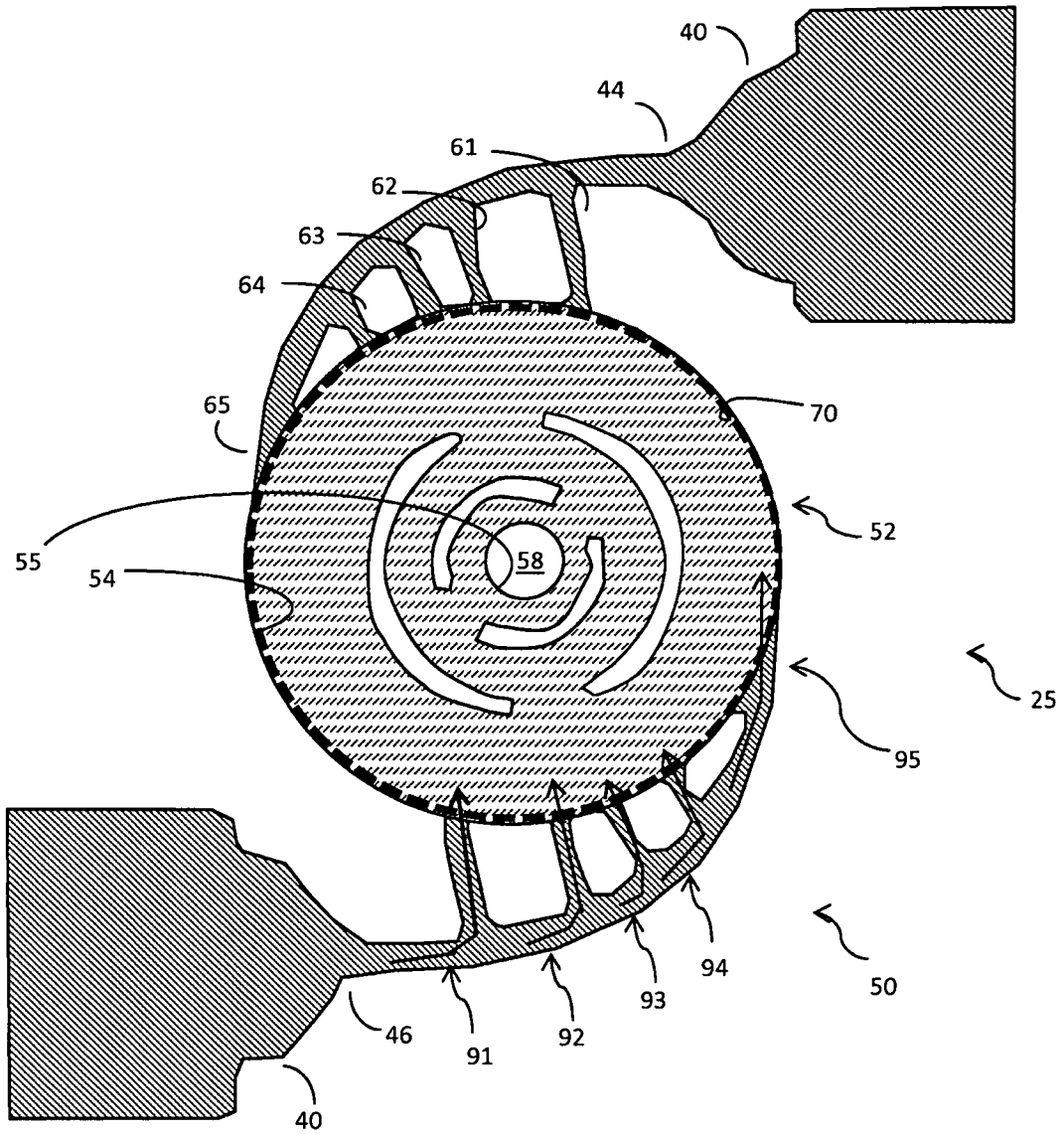
FIG. 3 is a schematic representational view of an autonomous flow control system according to an embodiment of the invention.

FIG. 3 is a schematic representational view of an autonomous flow control system 25 according to an embodiment of the invention. The autonomous flow control system comprises a flow ratio control system 40 and a pathway dependent resistance system 50, which may comprise a vortex chamber 52. The flow ratio control system 40 comprises at least one leading passageway 44, 46 in fluid communication with the pathway dependent resistance system 50 via a plurality of inlets 61-65. The flow ratio control system 40 is configured to direct the fluid from the at least one leading passageway 44, 46 into one or more inlets 61-65 leading to the vortex chamber 52 in the pathway dependent resistance system 50. In an embodiment, the flow ratio control system 40 is designed to divide the fluid flow into multiple streams of varying volumetric ratio by taking advantage of the characteristic properties of the fluid flow. Such properties can include, but are not limited to, the rheological properties of the fluid (e.g., kinematic viscosity, yield strength, viscoplasticity, surface tension, wettability, etc.), fluid viscosity, fluid density, flow rates, or any combination of the properties. The dividing of the fluid flow into multiple streams will now be explained.

As shown in FIG. 3, the flow ratio control system 40 comprises a plurality of inlets 61-65 stemming from each leading passageway 44, 46. The inlets 61-65 are each in series with the leading passageway 44, 46 from which they stem and the vortex chamber 52, while in parallel with one another. The flow ratio control system 40 can serve to divide the fluid stream into different streams of varying ratios and/or provide an entrance direction to the fluid flowing into the pathway dependent resistance system 50.

The plurality of passageways 91, 92, 93, 94, 95 can be selected to be of different configurations to provide differing resistance to fluid flow based on the characteristics of the fluid. The configuration can be based on flow characteristics of the passageways (e.g., diameter, length, etc.) and/or orientation of the various passageways 91, 92, 93, 94, 95 with respect to the leading passageway 44, 46. In an embodiment, one or more of the plurality of passageways 91, 92, 93, 94, 95 can be designed to provide greater resistance to desired fluids. In an embodiment, a fifth passageway 95 of the plurality of passageways may be a long, relatively narrow tube, which provides greater resistance to fluids such as oil and less resistance to fluids such as natural gas or water. Alternately, other designs for viscosity-dependent resistance tubes can be employed, such as a tortuous path or a passageway with a textured interior wall surface. Obviously, the resistance provided by a selected passageway varies infinitely with changes in the fluid characteristic. For example, a passageway may offer greater resistance to the fluid when the oil to natural gas ratio of the fluid is 90:10 than when the ratio is 50:50. Further, the passageway may offer relatively little resistance to some fluids such as natural gas or water.

A second passageway 92 of the plurality of passageways 91, 92, 93, 94, 95 may be designed to offer relatively constant resistance to a fluid, regardless of the characteristics of the fluid flow, or to provide greater resistance to undesired fluids. In an embodiment, the second passageway 92 may include at least one flow restrictor such as a venturi, an orifice, a narrow flow tube, a nozzle, and/or any combination thereof. The number and type of restrictors and the degree of restriction can be chosen to provide a selected resistance to fluid flow. While flow through the plurality of passageways may provide increased resistance to fluid flow as the fluid becomes more viscous, the resistance to flow may vary in each of the passageways. The varying resistance may then provide a differential flow through passageways to thereby separate the fluid to some degree. For example, the resistance to flow in the fifth passageway 95 may be greater than the resistance to flow in the second passageway 92.

Based upon the differential resistance to flow in the plurality of passageways 91, 92, 93, 94, 95, the flow ratio control system 40 can be used to divide a fluid into streams of a pre-selected flow ratio. Where the fluid may have multiple fluid components, the flow ratio will typically fall between the ratios for the two single components. Further, as the fluid composition changes in component constituency over time, the flow ratio will also change. The change in the flow ratio can be used to alter the fluid flow pattern into the pathway dependent resistance system 50.

The flow ratio control system 40 can be used to provide a direction for an incoming fluid into the pathway dependent resistance system 50, which may direct a selected ratio of the incoming fluid into the pathway dependent resistance system 50 at a selected orientation. Each passageway 91, 92, 93, 94, 95 provides a flow path into the vortex chamber 52 at a particular angle. The plurality of inlets 61-65 may comprise at least one high-angle inlet 61-64, which may be configured to direct fluid substantially towards the center of the vortex chamber 52, and at least one low-angle inlet 65, which may be configured to direct fluid along a path substantially tangential to the outer vortex peripheral wall 54.

The flow ratio control system 40 can be configured to direct a fluid through a particular inlet 61-65 according to the characteristics of the fluid. For example, a fluid possessing higher viscosity (e.g., oil) may be directed through a high-angle inlet 61-64, while a fluid possessing lower viscosity (e.g., water) may be directed through a low-angle inlet 65. A fluid switch (e.g., a selector and/or actuator) configured to direct a fluid into an appropriate pathway may be disposed within the flow ratio control system 40. The fluid switch (not shown) can be any type of switch that is capable of directing a fluid from one fluid flow path to one or more fluid flow paths. Examples of suitable fluid switches include, but are not limited to, a pressure switch, a mechanical switch, an electro-mechanical switch, a momentum switch, a fluidic switch, a bistable amplifier, and a proportional amplifier. Suitable actuators for use with autonomous flow control systems are described in U.S. Patent Publication No. 2012/0255739 entitled "Selectively Variable Flow Restrictor for Use in a Subterranean Well", Fripp et al., which is incorporated herein by reference in its entirety for all purposes.

The flow ratio control system 40 is in fluid communication with pathway dependent resistance system 50. In an embodiment, the pathway dependent resistance system 50 has a plurality of inlets 61-65 in fluid communication with the corresponding plurality of passageways 91, 92, 93, 94, 95, a vortex chamber 52, and an outlet 58. For example, in the embodiment shown in FIG. 3, passageway 91 forms with vortex chamber 52 periphery angle-1, passageway 92 forms with vortex chamber 52 periphery angle-2, passageway 93 forms with vortex chamber 52 periphery angle-3, passageway 94 forms with vortex chamber 52 periphery angle-4, and passageway 95 forms with vortex chamber 52 periphery angle-5. Angle-1, angle-2, angle-3, and angle-4 are associated with high-angle inlets 61-64 and each is configured to direct fluid flowing therethrough at least substantially towards the center of the vortex chamber 52. Angle-5, on the other hand, is associated with low-angle inlet 65 and it is configured to direct flowing therethrough along a substantially tangential path relative to outer vortex peripheral wall 54. Fluids entering the vortex chamber 52 primarily tangentially will spiral around the vortex chamber 52 before eventually flowing through the outlet 58. Fluid spiraling around the vortex chamber 52 will suffer from frictional losses. Further, the tangential velocity impedes radial flow. Fluids entering the vortex chamber 52 primarily radially, may primarily flow down the vortex chamber 52 and through the outlet 58 without spiraling. Consequently, the pathway dependent resistance system 50 provides greater resistance to fluids entering the vortex chamber 52 primarily tangentially than those entering primarily radially. This resistance is realized as back-pressure on the upstream fluid, and hence, a reduction in flow rate. Back-pressure can be applied to the fluid selectively by increasing the proportion of fluid entering the vortex chamber 52 primarily tangentially, and hence the flow rate reduced, as is done in the inventive concept. The differing resistance to flow between the plurality of passageways 91, 92, 93, 94, 95 in the flow ratio control system 40 results in a division of volumetric flow between the passageways 91, 92, 93, 94, 95. A ratio can be calculated from the volumetric flow rates. Further, the design of the inlets 61-65 can be selected to result in particular volumetric flow ratios. In an embodiment, the flow ratio control system 40 provides a mechanism for directing fluid which is relatively less viscous into the vortex chamber 52 primarily tangentially, thereby producing greater resistance and a lower flow rate to the relatively less viscous fluid than would otherwise be produced.

One or more portions of the autonomous flow control system 25 may be coated with a surface coating and/or surface features. The surface coating and/or surface features may alter the interfacial surface tension between the fluid and the surface, to thereby cause the fluid to move with either more or less resistance (e.g., drag, etc.) as it travels across the surface. The surface coating and/or surface features may make the surface hydrophilic or hydrophobic. In an embodiment, the surface coating and/or surface features may make the surface super hydrophobic.

Suitable surface coatings useful with the autonomous flow control systems described herein may comprise any substance configured to alter the interfacial energies between the fluid flowing through the autonomous flow control system and the material forming the autonomous flow control system. Such surface coatings may increase or decrease the interfacial energies with one or more fluids, thereby selectively increasing or decreasing the various forces between the fluid and the autonomous flow control system (e.g., drag, friction, etc.). In an embodiment, the surface coatings may comprise hydrophobic coatings, hydrophilic coatings, oleophobic coatings, oleophilic coatings, or any combination thereof. For example, in the embodiment depicted in FIG. 3, a hydrophobic coating 70 may be applied to inner vortex peripheral wall 55 to reduce the drag on an aqueous fluid swirling within the vortex chamber 52, thereby increasing the residence time of the fluid within the vortex chamber 52 and increasing the resistance to the flow of the aqueous fluid through the autonomous flow control system 25. As another example, the interior of one or more of the fluid passageways 91, 92, 93, 94, 95 may be coated with an oleophobic coating to reduce the resistance to the flow of oil through the corresponding passageway, thereby reducing the resistance to the flow of oil through the autonomous flow control system 25.

Due to surface tension, water droplets may assume a shape that minimizes their surface energy, (e.g., a generally spherical shape, in the absence of any other surfaces). When in contact with a solid surface, a water droplet shares a portion of its surface with the surface of the solid, and another portion of its surface with a surrounding fluid (e.g., a gas such as air). The area of the surface in common between the solid and the droplet may depend on the interactions between water molecules and the molecules at the surface of the solid. Solids that are hydrophobic or have a hydrophobic coating form a contact angle with water droplets of greater than 90 degrees (e.g., contact angle 401 between the water droplet 400 and the surfaces of FIG. 4A), as measured by a contact angle goniometer as described in ASTM Standard D7334-08 (Standard Practice for Surface Wettability of Coatings, Substrates and Pigments by Advancing Contact Angle Measurement, ASTM Int'l, West Conshohocken, Pa., 2008), which standard is incorporated herein in its entirety by this reference. Hydrophobic materials may include, but are not limited to, one or more olefinic monomers, oligomers, or polymers. In another embodiment, suitable hydrophobic materials can comprise silicone polymers (e.g., non-polar silicones), polyolefins and their copolymers such as ethylene, propylene, diene terpolymer (EPDM) rubbers, and acrylate polymers. In an embodiment, representative olefinic monomers, oligomers, or polymers include carbon-containing compounds having at least one site of unsaturation. The olefinic monomers, oligomers, or polymers comprise or include, in certain embodiments, a mixture of polyolefins, (meth)acrylate esters, allyl ethers, vinyl esters, vinyl ethers and the like. In an embodiment, the hydrophobic compounds may comprise silicone compounds, silanes, fluorocarbon polymers (e.g., perfluorocarbon polymers), perfluoroalkyl ethyl methacrylate (PPFEMA) coated polycaprolactone, hydrocarbons, polymer mats made of polystyrene and poly[tetrafluoroethylene-co-(vinylidene fluoride)-co-propylene] (PTVFP), or any combinations thereof.

In an embodiment, the surface coating and/or surface features may comprise a super hydrophobic structure and/or material. In general, a super hydrophobic material refers to any surface having a contact angle with a water droplet in air of at least 150 degree, as measured by a contact angle goniometer as described in ASTM Standard D7334-08. Super hydrophobic materials generally comprise hydrophobic materials (e.g., any of those hydrophobic materials described and listed above) disposed in pattern on a surface. A patterned surface of a hydrophobic material may form a larger contact angle with water than a smooth surface of the same hydrophobic material. While not intending to be limited by theory, it is believed that nanoscale air pockets may become trapped between water droplets and recesses of a patterned surface comprising a hydrophobic material. In other words, when a patterned surface is used, repulsive forces between water droplets and hydrophobic patterned surfaces may be stronger than repulsive forces between water droplets and flat surfaces of the same material. Stronger repulsive forces may help water droplets to roll off the surfaces, giving patterned hydrophobic surfaces a self-cleaning property, which may be referred to as the "Lotus effect".

In an embodiment, a hydrophobic material may be disposed in a microscale and/or nanoscale pattern on a surface. A nanoscale pattern refers to a three-dimensional topography of features (e.g., protrusions, recesses, peaks, valleys, bowls, etc.) having at least one dimension of about 1 micron or less. A microscale pattern refers to a three-dimensional topography of features (e.g., protrusions, recesses, peaks, valleys, bowls, etc.) having at least one dimension of about 1 mm or less. A hierarchical pattern refers to a three-dimensional topography of features (e.g., protrusions, recesses, peaks, valleys, bowls, etc.) having a nanoscale pattern disposed on at least a portion of a microscale pattern. A nanoscale pattern, a microscale pattern, and or a hierarchical pattern may be disposed on an otherwise flat surface or on a surface having an underlying curvature or features larger than the features of the corresponding nanoscale pattern, a microscale pattern, and/or a hierarchical pattern.

Figure 4A:
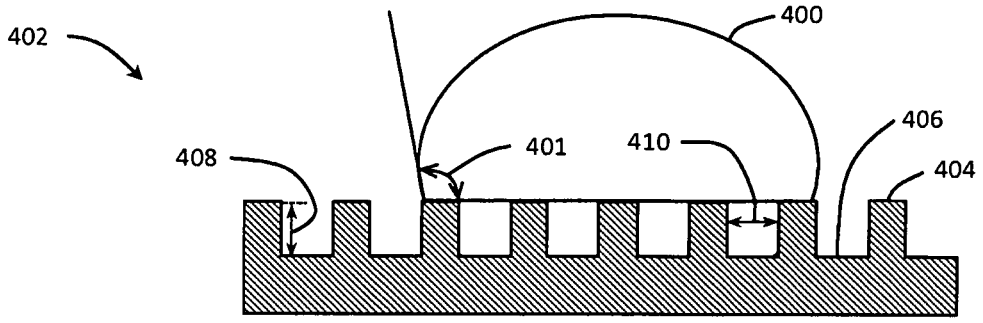
FIGS. 4A-4C are a schematic representational views pattern on a surface according to several embodiments.

When a hydrophobic material is used as a surface coating, the hydrophobic material may be disposed over at least a portion of the autonomous flow control system in a pattern, such as a nanoscale pattern, a microscale pattern, and or a hierarchical pattern. The use of the hydrophobic material in such a patterned surface may impart super hydrophobic properties to a hydrophobic material. As shown in FIG. 4A, a pattern (e.g., a nanoscale pattern, and/or a microscale pattern) may include a plurality of protrusions 404 having corresponding recesses 406 disposed there between. The adjacent protrusions 404 may each have the same height 408 relative to the underlying surface, or the height 408 of the protrusions 404 may be different. The distance 410 between adjacent protrusions 404 (e.g., the pitch of the protrusions) may each be the same, or the distance 410 may be different. For a microscale pattern, the features may generally have a height 408 between about 1 micrometer and 500 micrometers, and the distance 410 may generally be less than the height 408.

The microscale pattern 402 may comprise features of any number of shapes. While illustrated in FIG. 4A as having generally rectangular or castellated cross-sections, the protrusions 404 may have various other cross-sectional shapes such as sinusoidal, arced, frusto-conical, conical, or the like. Further, the protrusions 404 and the recesses 406 may form discontinuous patterns on a surface or continuous patterns. A discontinuous pattern may form a continuous slot or trench between adjacent protrusion 404 peaks that may extend for a distance along the surface that is substantially greater than the distance 410 between the protrusions 404. For example, a discontinuous pattern may comprise generally parallel slots extending along the surface of at least a portion of the autonomous flow control system. A continuous pattern may comprise a continuous raised surface and/or a continuous depressed surface. For example, the protrusions may form a continuous raised surface having pits, holes, or other such recesses formed in the surfaces that do not connect.

Figure 4B:
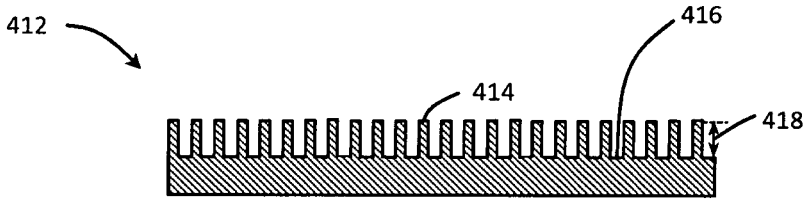
Figure 4C:
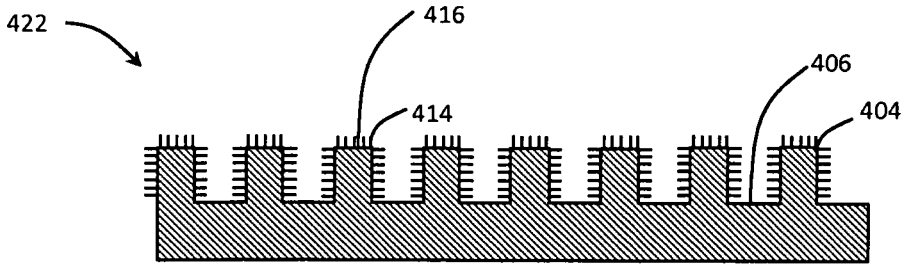

FIGS. 4B and 4C illustrate similar surfaces having nanoscale patterns 412 and hierarchical patterns 422, respectively. The nanoscale pattern 412 illustrated in FIG. 4B may be similar to the microscale pattern 402 illustrated in FIG. 4A except that the features may be on a nanoscale. In an embodiment, the features may generally have a height 418 between about 1 nanometer and 500 nanometers, and the pitch of the protrusions 414 and/or recesses 416 may generally be less than the height 418. The hierarchical pattern 422 illustrated in FIG. 4C generally comprises a microscale pattern that may be the same as or similar to the microscale pattern 402 illustrated in FIG. 4A with a nanoscale pattern disposed on the surface of the protrusions 404 and/or the recesses 406. For example, the nanoscale pattern disposed on the microscale pattern may be the same as or similar to the nanoscale pattern 412 illustrated in FIG. 4B. Any of the considerations for the microscale pattern and/or the nanoscale pattern described herein may apply to the corresponding portion of the hierarchical pattern. Furthermore, any of the features of the patterns shown in FIGS. 4A-4C may be combined into a single pattern. Any other nanoscale pattern, microscale pattern, and/or hierarchical pattern capable of rendering a hydrophobic surface super hydrophobic may also be used.

Various methods of applying the pattern to a surface of the autonomous inflow control device may be used. In an embodiment, a patterned surface may be formed on a separate coating and applied to the autonomous flow control system. For example, a thin film having a suitably patterned hydrophobic surface may be formed and be applied to a surface of the autonomous flow control system. In some embodiments, the pattern of hydrophobic material may be formed directly on one or more portions of the autonomous flow control system. Various methods of forming and/or applying a microscale pattern, nanoscale pattern, and/or hierarchical pattern to a surface may be used. Suitable methods may include, but are not limited to, plasma etching, chemical etching, laser etching, nanoscale lithography, sol gel precipitation techniques, nanocasting, or any combination thereof.

Returning to FIG. 3, the areas treated with a hydrophobic material may be selected to provide for a modification of the interfacial energies within the autonomous flow control system 25 to allow for a greater separation within the flow ratio control system 40 and/or a greater difference in the resistance to flow between desired fluids and undesired fluids in the pathway dependent resistance system 50. In the embodiment illustrated in FIG. 3, the autonomous flow control system 25 comprises a hydrophobic and/or super hydrophobic coating 70 applied to the outer vortex peripheral wall 54. Such an embodiment may be effective when the undesired fluid is water and the desired fluid is oil. However, the description of oil and water used herein is strictly exemplary and those skilled in the art will recognize that the embodiment of FIG. 3 can also effectively operate with various other undesired fluids besides water and other desired fluids besides oil. While described in terms of a super hydrophobic coating, other types of coatings can be used. For example, the outer vortex peripheral wall 54 can be coated with a hydrophobic coating that is not super hydrophobic, or alternatively, the vortex chamber 52 can be coated with a hydrophilic coating. Those skilled in the art can appreciate that the outer vortex peripheral wall 54, and/or any other surface of the vortex chamber 52, can be coated with virtually any type of coating deemed appropriate, and the appropriateness can be based on a particular fluid or fluids whose flow rate the user is aiming to control. Once a fluid is identified, the coating can be selected according to its physical properties. Particularly, the coating can be selected in order to alter the interfacial surface tension between the fluid and the surface, to thereby adjust the friction between the fluid and the surface. For example, the coating applied to the outer vortex peripheral wall 54 may be super hydrophobic, and thus the coating may reduce the coefficient of friction between the wall and water. Therefore, water may experience a reduced drag compared to a surface without the coating as it flows along the wall, and in turn, the water may maintain its angular momentum. As a result, the resistance to the flow of water through the autonomous flow control system 25 may be increased, and the amount of water entering the interior of the wellbore tubular may be reduced.

In operation, the autonomous flow control system 25 can be incorporated into a production tubing section 24 and installed within a wellbore 12. Upon production, fluid travels from the wellbore exterior, into the screen system 28, and into the flow ratio control system 40 where it enters at least one passageway 91, 92, 93, 94, 95. There, the fluid is directed from at least one passageway 91, 92, 93, 94, 95 via a selected at least one inlet 61-65 into the vortex chamber 52. As shown in FIG. 3, oil may be directed through a first inlet 61, while water may be directed through a fifth inlet 65. As a result, oil can enter the vortex chamber 52 substantially radially and travel through the vortex center. Water, on the other hand, may enter the vortex chamber 52 substantially tangentially and swirl around the outer vortex peripheral wall 54 of the vortex chamber 52 in a circular manner. When the outer vortex peripheral wall 54 comprises a super hydrophobic coating 70, the coefficient of friction between the outer vortex peripheral wall 54 and water is reduced. As a result, the water experiences less drag as it swirls, and thus its loss in speed is reduced. In turn, the water's loss of angular momentum may be reduced. Since the water's angular momentum is better maintained, the water may continue to travel in a circular manner instead of flowing radially inwards. Consequently, the swirling flow may produce back-pressure on the water located upstream, and thus decreases the flow rate of the water. Therefore, the disclosed autonomous flow control system 25 may reduce the production of water while increasing the production of oil.

Figure 5:
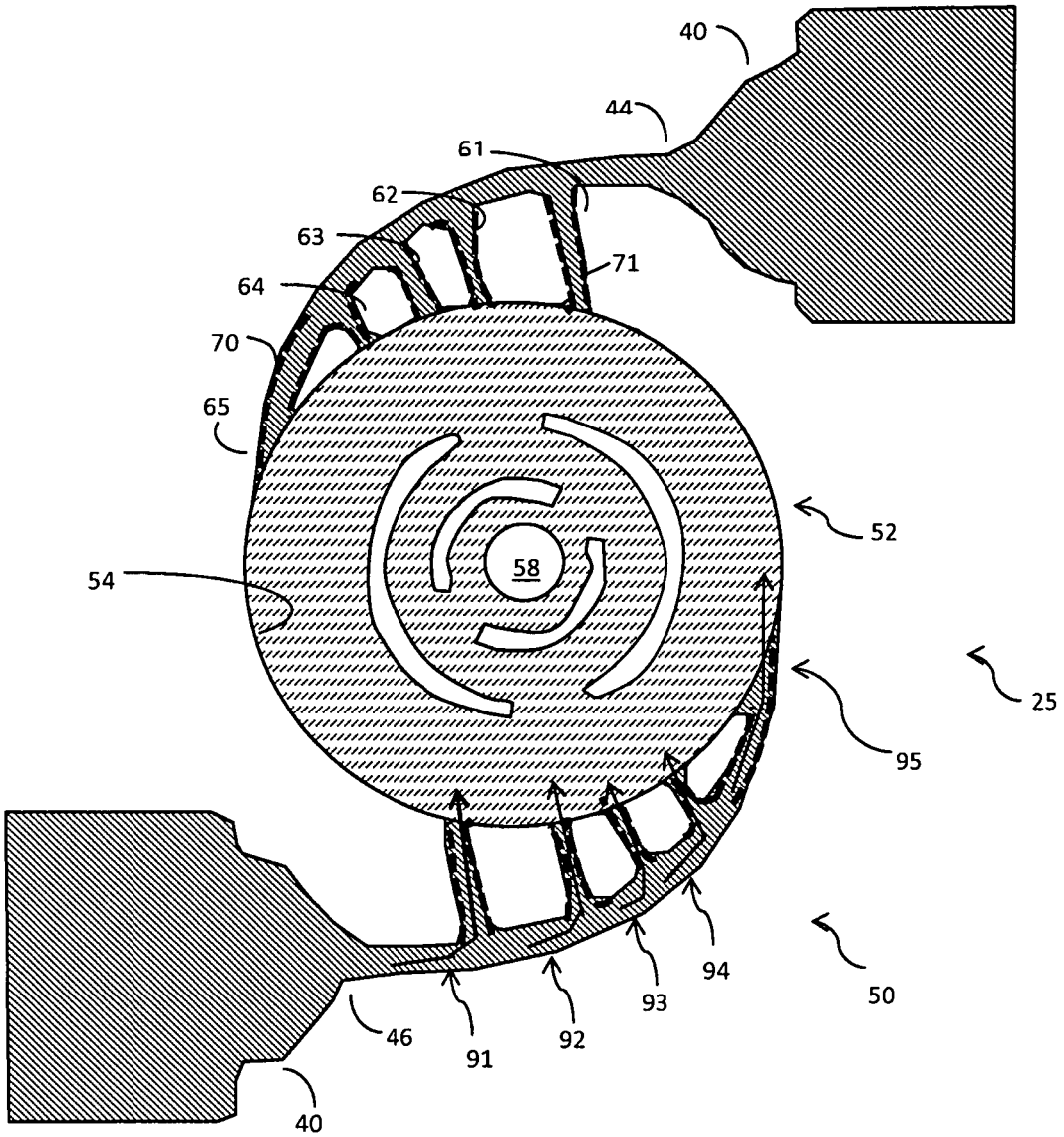
FIG. 5 is a schematic representational view of an autonomous flow control system according to another embodiment of the invention.

In another embodiment shown in FIG. 5, the inner walls of the low-angle inlet 65 comprise a super hydrophobic coating 70, and the inner walls of the high-angle inlets 61-64 comprise an oleophobic and/or hydrophilic surface 71. The super hydrophobic coating 70 applied to the inner walls of high-angle inlet 65 may reduce the drag between water and the inner walls of the passageway 95, thereby decreasing the resistance to the flow of water through the passageway 95. The water may then enter the vortex chamber 52 with increased angular momentum, which may result in an increase in the resistance to the flow of the water through the autonomous flow control system 25. In addition, since it decreases the coefficient of friction between the wall of the low-angle inlet 65 and water, the super hydrophobic coating 70 may improve the selectivity of the portion of the incoming fluid comprising water being directed to the low-angle inlet 65 rather than flowing through a high-angle inlet 61-64. The application of an oleophobic and/or hydrophilic surface 71 to the high-angle inlets 61-64 may reduce the resistance to the flow of oil or a hydrocarbon through the high-angle inlets 61-64. This may in turn reduce the overall resistance to flow of oil through the autonomous flow control system 25. In the embodiment illustrated in FIG. 5, the autonomous flow control system 25 also comprises a hydrophobic and/or super hydrophobic coating 70 applied to the outer vortex peripheral wall 54. However, in other embodiments, the flow ratio control system 40 comprises one more coated portions while the vortex chamber 52 does not comprise any coated portions.

In some embodiment, all the passageways 91, 92, 93, 94, 95 can be coated with a coating. In some embodiments, less than all passageways 91, 92, 93, 94, 95 are coated and/or only a portion of one of more of the passageways 91, 92, 93, 94, 95 may be coated with a coating. In some embodiments, at least one low-angle passageway 95 comprising a low-angle inlet 65 is coated with a hydrophobic and/or super hydrophobic coating 70 and at least a portion of at least one high-angle passageway 91, 92, 93, 94 is coated with an oleophobic and/or hydrophilic surface 71, but not the at least a portion of at least one high-angle passageway 91, 92, 93, 94 is uncoated. Any suitable combination of coatings may be applied to achieve the desired effect through the autonomous flow control system 25, which may be based at least in part on the type of desired and undesired fluids, and the design of the autonomous flow control system 25.

Figure 6:
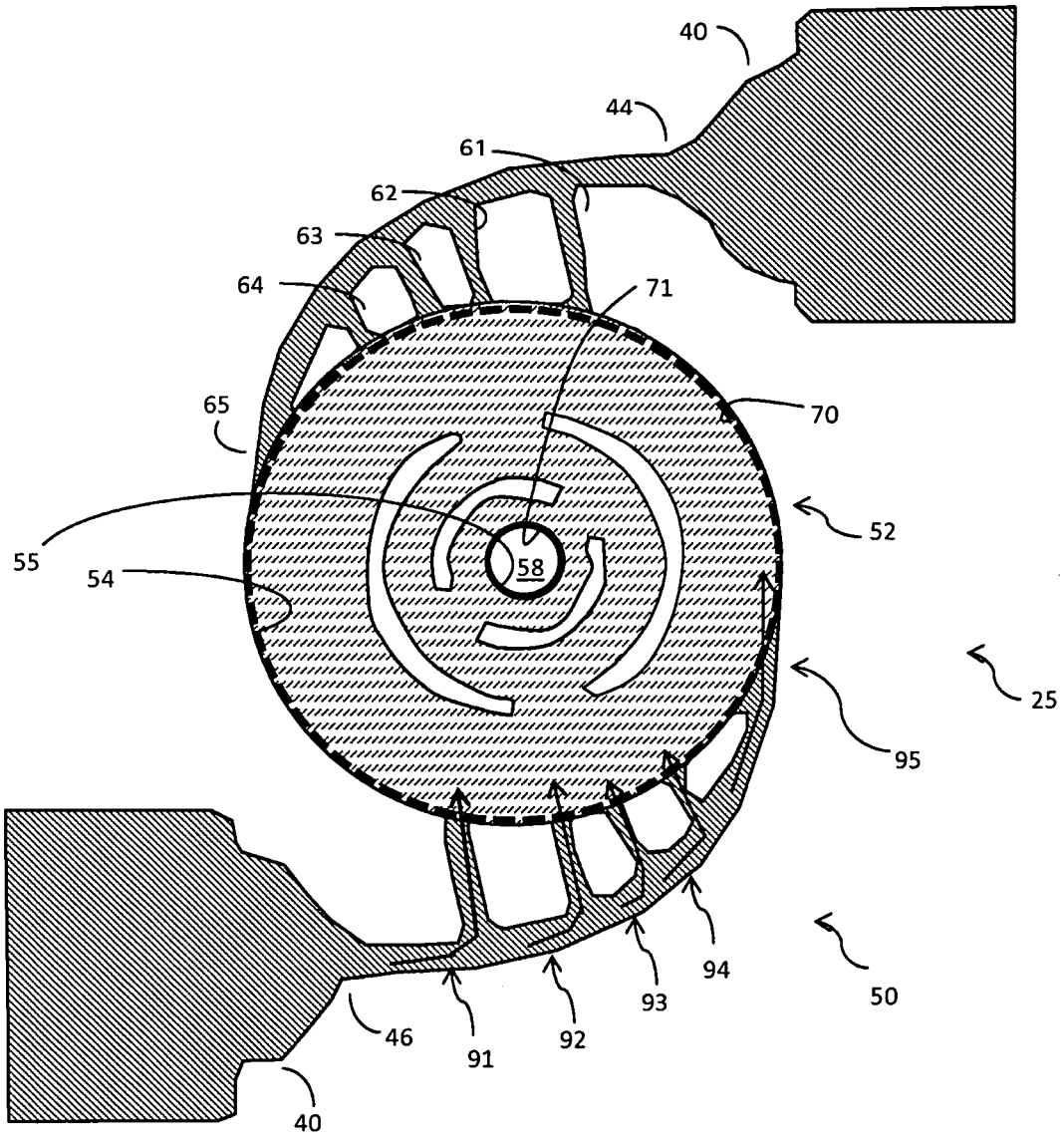
FIG. 6 is a schematic representational view of an autonomous flow control system according to yet another embodiment of the invention.

Referring next to FIG. 6, therein is depicted an embodiment, wherein the autonomous flow control system 25 comprises more than one type of surface coating and/or surface features applied to more than one portion of the vortex chamber 52. In the particular embodiment as shown in FIG. 6, the vortex chamber 52 can comprise two portions: an inner vortex peripheral wall 55 and an outer vortex peripheral wall 54. The outer vortex peripheral wall 54 may comprise a hydrophobic and/or a super hydrophobic coating 70, and the inner vortex peripheral wall 55 may comprise an oleophobic and/or hydrophilic surface 71. The embodiment of FIG. 6 may be effective when the undesired fluid is water and the desired fluid is oil, and thus, the operation of the embodiment will be described in terms of oil and water. However, the description of oil and water used herein is merely exemplary and those skilled in the art will recognize that the FIG. 6 embodiment can also effectively operate with various undesired fluids besides water and various desired fluids besides oil. Also, although the FIG. 6 embodiment comprises a super hydrophobic coating, other types of coatings can be used. For example, the vortex chamber 52 can be coated with a hydrophobic coating that is not super hydrophobic. Those skilled in the art can appreciate that the vortex chamber 52 can be coated with virtually any type of coating deemed appropriate, and the appropriateness can be based on a particular fluid or fluids whose flow rate the user is aiming to control. Once a fluid is identified, the coating can be selected according to its physical properties. Particularly, the coating can be selected in order to alter the interfacial surface tension between the fluid and the surface.

The super hydrophobic coating 70 applied to the outer vortex peripheral wall 54 may prolong the water's circular flow path around the outer periphery of the vortex chamber 52 in much the same way as does the super hydrophobic coating 70 described with respect to the embodiment of FIG. 3. The super hydrophobic coating 70 may reduce the drag on the flowing water, thereby increasing the resistance to the flow of water through the autonomous flow control system 25. The oleophobic and/or hydrophilic surface 71 applied to the inner vortex peripheral wall 55 also assists in preventing the water from flowing radially inwards; however, the hydrophilic coating does not operate by decreasing the friction between the water and the inner peripheral wall. On the contrary, the oleophobic and/or hydrophilic surface 71 actually increases the drag on the water as it travels along the inner vortex peripheral wall 55. Nonetheless, the oleophobic and/or hydrophilic surface 71 may help to reduce the production rate of undesired fluid. In general, two factors may contribute to the reduction of the water's flow speed through the vortex chamber 52: first, maintaining the water's angular momentum, thereby causing it to swirl radially instead of travelling laterally through the vortex chamber 52 (hence the super hydrophobic coating 70); and second, increasing the drag on the water once the water begins to move towards the outlet 58 (hence the oleophobic and/or hydrophilic surface 71). Since reducing the water's kinetic energy leads to a loss in angular speed, the two factors counteract one another. Thus, the peripheral walls of FIG. 6 can be engineered to strike this very balance. Specifically, those skilled in the art will recognize that the dimensions of the inner vortex peripheral wall 55 and the outer vortex peripheral wall 54 can be altered to provide a desired flow pattern in the vortex chamber 52.

The oleophobic and/or hydrophilic surface 71, applied to the inner vortex peripheral wall 55, may increase the drag on the water as it travels thereacross, and thus, the hydrophilic surface decreases the water's overall speed as it moves within the inner portion of the vortex chamber 52. As a result, because the water in the inner portion of the vortex chamber 52 moves slower, back-pressure is created on the water located in the outer portion of the vortex chamber 52. Therefore, the water located in the outer portion of the vortex chamber 52 moves with a reduced flow speed. However, because the outer portion of the vortex chamber 52 comprises a super hydrophobic coating 70, the water located in the outer portion may maintain its angular speed for a longer period of time and continue to swirl.

Figure 7:
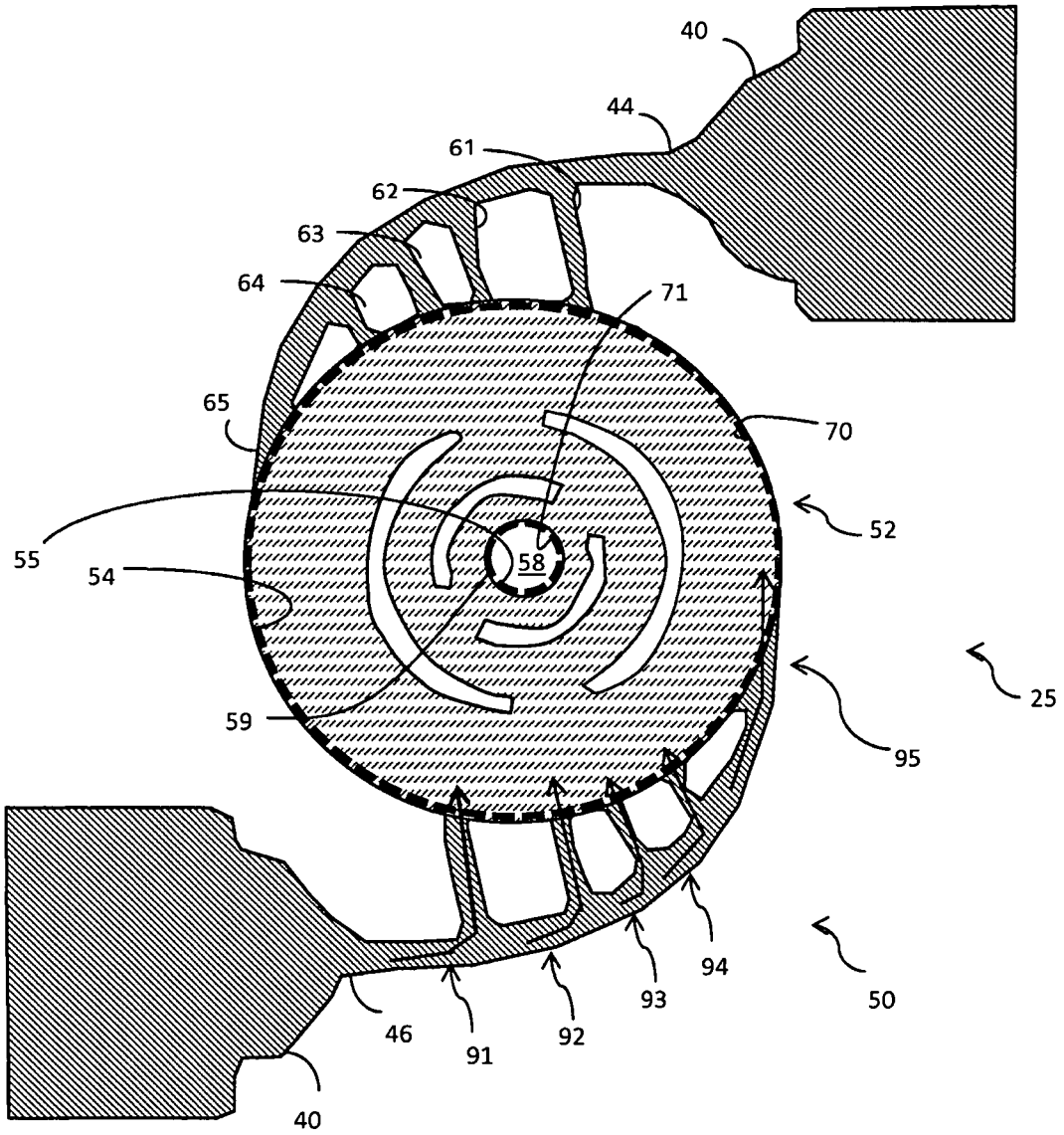
FIG. 7 is a schematic representational view of an autonomous flow control system according to yet another embodiment of the invention.

Turning to FIG. 7, at least a portion of the outlet wall 59 may comprise at least one type of surface coating and/or surface features that alters the interfacial surface tension between the outlet 58 and a fluid flowing therethrough. In this embodiment, the outlet wall 59 may comprise an oleophobic and/or hydrophilic surface 71. In operation, the oleophobic and/or hydrophilic surface 71 increases the oil's flow rate as it exits the autonomous flow control system 25 through the outlet 58. The oleophobic and/or hydrophilic surface 71 may reduce the friction between the outlet wall 59 and the oil, thereby increasing the oil's velocity as it travels through the outlet 58 and into the wellbore tubular interior. As a result, the outlet 58 may reduce the resistance to the production of oil. The oleophobic and/or hydrophilic surface 71 may further increase the drag with water flowing through the outlet 58. Depending on the diameter of the outlet 58, the oleophobic and/or hydrophilic surface 71 may further provide a pore pressure opposing the flow of water through the outlet. As a result, the outlet 58 comprising an oleophobic and/or hydrophilic surface 71 may increase the resistance to the flow of water through the autonomous flow control system 25.

In operation, the fluid flows from the formation 20, into the production tubing section 24, travelling first through the screen system 28, if present, and then into the flow ratio control system 40. Once in the flow ratio control system 40, the fluid flows through the at least one leading passageway 44, 46 of the flow ratio control system 40. There, it is directed into an appropriate inlet 61-65, based on the physical properties of the fluid and the configuration of the flow ratio control system 40. A fluid switch (not shown) may be disposed within the flow ratio control system 40 to control the selection of the leading passageways 44, 46 and/or inlets 61-65. In an embodiment, the flow ratio control system 40 directs at least a portion of any low viscous fluids (e.g., water) through the high-angle inlets 61-64, while directing at least a portion of any high viscosity fluids (e.g., oil) through the low-angle inlet 65. For example, the flow ratio control system 40 may cause at least a portion of any water to enter the vortex chamber 52, substantially tangentially, and swirl around the vortex chamber 52, while causing at least a portion of the oil to enter the vortex chamber 52 and flow towards the outlet 58. Various portions of the autonomous flow control system 25 may comprise a surface coating and features. In an embodiment, the leading passageways 44, 46 may comprise a hydrophobic and/or super hydrophobic coating 70, which decreases the resistance to the flow of water as it moves thereacross and thus improves the selectivity of the water towards the tangential inlets 61-65. The high-angle inlets 61-64 may comprise a hydrophilic coating, which may decrease the resistance to the flow of oil through the high-angle inlets 61-64 and improve the selectivity of the oil towards the high-angle inlets 61-64.

Moreover, the hydrophobic, super hydrophobic, and/or hydrophilic coatings may help to improve the resistance (e.g., increase resistance and/or decrease resistance) characteristics of the autonomous flow control system 25 within the pathway dependent resistance system 50. While the flow ratio control system 40 determines each fluid's initial flow path, the initial flow path is thereafter preserved to some degree within the vortex chamber 52. One or more surface coatings and/or features within the vortex chamber 52 may conserve the angular momentum of the undesired fluid and thus prolong its circular flow. The autonomous flow control system 25 can comprise a surface coating and/or surface features applied to the inner vortex peripheral wall 55 of the vortex chamber to alter the interfacial surface tension. Accordingly, the disclosed autonomous flow control system 25 may increase the resistance to the production of one or more undesired fluids and/or decrease the resistance to the production of one or more desired fluids.

While described in terms of an autonomous flow control system 25, comprising flow ratio control system 40 and a pathway dependent resistance system 50, various other flow control systems may benefit from the use of one or more surface coatings and/or surface features. For example, an autonomous flow control system 25 may comprise a flow ratio control system 40 having only a single inlet, and the degree of resistance to a fluid may be based on the fluid properties and the flow rate through the system. In this embodiment, one or more portions of the pathway dependent resistance system 50 may comprise one or more surface coatings and/or surface features.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An autonomous flow control system for use downhole comprising:

a vortex chamber comprising a super hydrophobic surface;

a first leading passageway that directs fluid into the vortex chamber via a first inlet and a second inlet; and a second leading passageway that directs fluid into the vortex chamber via a third inlet and a fourth inlet, wherein the first leading passageway and the second leading passageway are separated by the vortex chamber.

2. The autonomous flow control system of claim 1, wherein the super hydrophobic surface comprises a hydrophobic surface coating.

3. The autonomous flow control system of claim 1, wherein the super hydrophobic surface comprises a pattern of hydrophobic material.

4. The autonomous flow control system of claim 3, wherein the pattern comprises at least one of a nanoscale pattern, a microscale pattern, a hierarchical pattern.

5. The autonomous flow control system of claim 3, wherein the pattern comprises a continuous surface pattern.

6. The autonomous flow control system of claim 1, wherein the super hydrophobic surface comprises substantially all of the surface of the vortex chamber.

7. The autonomous flow control system of claim 1, wherein the vortex chamber further comprises a hydrophilic surface disposed over at least a portion of the vortex chamber.

8. The autonomous flow control system of claim 7, wherein the vortex chamber comprises a vortex outlet, wherein the hydrophilic surface is disposed about the vortex outlet, and wherein the super hydrophobic surface is disposed about the hydrophilic surface.

9. The autonomous flow control system of claim 1, wherein the vortex chamber comprises a vortex outlet, and wherein the vortex outlet comprises a hydrophilic surface disposed over at least a portion of the vortex outlet.

10. The autonomous flow control system of claim 1, wherein at least one of the inlets comprises a second super hydrophobic surface.

11. The autonomous flow control system of claim 10, wherein the second super hydrophobic surface comprises a hydrophobic material disposed on a patterned surface.

12. The autonomous flow control system of claim 11, wherein the patterned surface comprises at least one of a nanoscale pattern, a microscale pattern, or a hierarchical pattern.

13. The autonomous flow control system of claim 1, wherein the hydrophobic material comprises at least one compound selected from the group consisting of: a silicone polymer, a polyolefin, a polyolefin copolymer, a silane, a fluorocarbon polymer, and any combination thereof.

14. The autonomous flow control system of claim 1, wherein the pathway dependent resistance system comprises a surface feature applied to at least a portion of the vortex chamber, wherein the surface feature alters the surface energy between the at least the portion of the vortex chamber and a fluid relative to an uncoated portion of the vortex chamber.

15. The autonomous flow control system of claim 1, wherein the first and second inlets are disposed in parallel with one another, wherein the first and second fluid inlets are in fluid communication with the first leading passageway, and wherein at least a portion of the first leading passageway comprises a second super hydrophobic surface.

16. A method of providing a variable resistance to fluid flow in a wellbore, the method comprising:

receiving a first fluid and a second fluid at an autonomous inflow control device;

directing the first fluid into a vortex chamber via a first leading passageway coupled to the vortex chamber by a first inlet and a second inlet, and directing the second fluid toward the vortex chamber via a second leading passageway coupled to the vortex chamber by a third inlet and a fourth inlet, wherein the first leading passageway and the second leading passageway are separated by the vortex chamber; and changing the resistance to flow of at least a portion of the first fluid and a portion of the second fluid with a super hydrophobic surface within the vortex chamber, wherein the resistance to flow through the autonomous inflow control device varies based on a fluid pathway through the vortex chamber.

17. The method of claim 16, further comprising changing the resistance to flow of a portion of the first fluid and a portion of the second fluid with a hydrophilic surface within the vortex chamber.

18. The method of claim 16, wherein at least one of the first and second inlets, comprises a hydrophobic surface, and, wherein at least one of the third and fourth inlets comprises a hydrophobic surface, wherein the flow resistance through the autonomous inflow control device varies between the inlets.

19. The method of claim 16, wherein at least one of the inlets of the comprises a second hydrophobic surface.

20. The method of claim 19, wherein the second hydrophobic surface comprises a second super hydrophobic surface.

* * * * *